US011363932B2

(12) United States Patent
Holmes et al.

(10) Patent No.: US 11,363,932 B2
(45) Date of Patent: Jun. 21, 2022

(54) TOOL FOR A SURFACE CLEANING APPARATUS

(71) Applicant: TTI (Macao Commercial Offshore Limited), Avenida da Praia Grande (CN)

(72) Inventors: Darren Holmes, Birmingham (GB); Richard David Waters, Birmingham (GB); Steven James Rogers, Birmingham (GB); Guy Lawrence Newsom, Birmingham (GB); Matthew James Ward, Birmingham (GB)

( * ) Notice: Subject to any disclaimer, the term of this patent is extended or adjusted under 35 U.S.C. 154(b) by 118 days.

(21) Appl. No.: 16/482,360

(22) PCT Filed: Feb. 2, 2018

(86) PCT No.: PCT/GB2018/050319
§ 371 (c)(1),
(2) Date: Jul. 31, 2019

(87) PCT Pub. No.: WO2018/142160
PCT Pub. Date: Aug. 9, 2018

(65) Prior Publication Data

US 2020/0000304 A1 Jan. 2, 2020

(30) Foreign Application Priority Data

Feb. 3, 2017 (GB) ..... GB1701804.5

(51) Int. Cl.
*A47L 11/40* (2006.01)
*A47L 9/24* (2006.01)

(52) U.S. Cl.
CPC ..... *A47L 11/4036* (2013.01); *A47L 9/246* (2013.01)

(58) Field of Classification Search
CPC ..... A47L 11/00; A47L 11/40; A47L 11/4036; A47L 11/4041; A47L 9/00; A47L 9/24;
(Continued)

(56) References Cited

U.S. PATENT DOCUMENTS

2001/0023517 A1* 9/2001 Onishi ..... A47L 9/02 15/351
2011/0219580 A1 9/2011 Conrad
(Continued)

FOREIGN PATENT DOCUMENTS

EP 1875846 A2 1/2008
GB 2402047 A 12/2004
(Continued)

OTHER PUBLICATIONS

United Kingdom Patent Office Search Report for Application No. 1701804.5, dated May 26, 2017, 2 pages.
International Search Report and Written Opinion for Application No. PCT/US2018/050319, dated Jun. 5, 2018, 14 pages.

*Primary Examiner* — Joseph J Hail
*Assistant Examiner* — Timothy Brady
(74) *Attorney, Agent, or Firm* — Michael Best & Friedrich LLP

(57) ABSTRACT

A tool for a surface cleaning apparatus, including a floor head including a floor facing surface which defines an inlet for receiving dirt-laden air, which inlet is generally positioned in a first plane P; a passage for carrying dirt-laden air from the floor head to the apparatus; a connecting member for connecting the tool to a surface cleaning apparatus, wherein the floor head and connecting member are pivotally connected about an axis A; and a blocking device for inhibiting pivotal movement of the connecting member about axis A. The blocking device is moveable to a blocking
(Continued)

condition in which pivotal movement of the connecting member downwardly outside of a pre-determined use condition is inhibited.

24 Claims, 15 Drawing Sheets

(58) Field of Classification Search
CPC . A47L 9/242; A47L 9/246; A47L 5/36; A47L 5/22; A47L 5/12; A47L 7/0014; A47L 9/02; A47L 9/04; A47L 9/068; A47L 9/0686; A47L 9/0693; A47L 9/248; A46B 5/002; A46B 5/0054; A46B 5/0075; A46B 5/0083
USPC ..... 15/347, 250.32, 300.1, 328, 329, 331, 15/334, 354, 359, 414, 415.1
See application file for complete search history.

(56) References Cited

U.S. PATENT DOCUMENTS

| | | | | |
|---|---|---|---|---|
| 2012/0090131 | A1 | 4/2012 | Woerwag | |
| 2014/0033473 | A1* | 2/2014 | McVey | A47L 9/02 15/415.1 |
| 2015/0000069 | A1* | 1/2015 | Conrad | A47L 9/16 15/324 |
| 2019/0059672 | A1* | 2/2019 | Zhang | A47L 9/244 |

FOREIGN PATENT DOCUMENTS

| | | | |
|---|---|---|---|
| GB | 2471164 | A | 12/2010 |
| GB | 2488405 | A | 8/2012 |
| GN | 105125142 | A | 12/2015 |
| WO | 20160107633 | A1 | 7/2016 |
| WO | 20160107634 | A1 | 7/2016 |

* cited by examiner

TOOL FOR A SURFACE CLEANING APPARATUS

CROSS-REFERENCE TO RELATED APPLICATIONS

This application is a U.S. National Phase of International Patent Application No. PCT/GB2018/050319, filed Feb. 2, 2018, which claims priority to U.K. Patent Application No. 1701804.5, filed Feb. 3, 2017, the entire contents all of which are hereby incorporated by reference herein.

BACKGROUND

This invention relates to a tool for a surface cleaning apparatus and in particular, but not exclusively, to a surface cleaning apparatus including such a tool.

There is a need for surface cleaning apparatus to be more efficient at cleaning, i.e. for a suction motor of a given power rating, to pick up relatively more dirt or debris from a surface during use. Various approaches have been adopted in the prior art to improve cleaning efficiency. For example, one approach has been to optimise the flow of air inside cyclonic separators for surface cleaning apparatus that utilise cyclonic separation to collect dirt or debris. Another approach has been to change the geometry of the tool which is fluidly connected to the apparatus for receiving dirt-laden air so that the air flow characteristics through a suction inlet of the tool are improved.

The present invention seeks to address this problem with a hitherto not realised approach.

SUMMARY

According to a first aspect of the invention we provide a tool for a surface cleaning apparatus, including:

a floor head including a floor facing surface which defines an inlet for receiving dirt-laden air, which inlet is generally positioned in a first plane P;

a passage for carrying dirt-laden air from the floor head to the apparatus;

a connecting member for connecting the tool to a surface cleaning apparatus, wherein the floor head and connecting member are pivotally connected about an axis A; and a blocking device for inhibiting pivotal movement of the connecting member about axis A, wherein the blocking device is moveable to a blocking condition in which pivotal movement of the connecting member downwardly outside of a pre-determined use condition is inhibited.

The tool may include a further blocking device for inhibiting pivotal movement of the connecting member away from an upright storage condition.

The connecting member may have an elongate axis C and the pre-determined use condition corresponds to an angle Θ between the elongate axis C and the first plane P being greater than 35°.

According to a second aspect of the invention we provide a tool for a surface cleaning apparatus, including:

a floor head including a floor facing surface which defines an inlet for receiving dirt-laden air, which inlet is generally positioned in a first plane P;

a passage for carrying dirt-laden air from the floor head to the apparatus;

a connecting member or a part thereof having an elongate axis C for connecting the tool to a surface cleaning apparatus, wherein the floor head and connecting member are pivotally connected about an axis A; and a blocking device for inhibiting pivotal movement of the connecting member about axis A, wherein the blocking device is moveable to a blocking position in which the blocking device inhibits movement of the connecting member such that an angle Θm between the elongate axis C and the floor surface is at least 35°.

According to a third aspect of the invention we provide a tool for a surface cleaning apparatus, including:

a floor head including a floor facing surface which defines an inlet for receiving dirt-laden air, which inlet is generally positioned in a first plane P;

a passage for carrying dirt-laden air from the floor head to the apparatus;

a connecting member or a part thereof having an elongate axis C for connecting the tool to a surface cleaning apparatus, wherein the floor head and connecting member are pivotally connected about an axis A; and a blocking device for inhibiting pivotal movement of the connecting member about axis A, wherein the blocking device is moveable to a blocking position in which the blocking device inhibits movement of the connecting member such that an angle Θm between the elongate axis C and the first plane P is at least 35°.

The first plane P and the floor surface may lie in the same plane.

The connecting member may include a portion which is rotatably supported by the floor head to provide the pivotal connection between the connecting member and the floor head.

The blocking device may include:

a blocking member moveable between blocking and non-blocking positions which correspond to blocking and non-blocking conditions of the blocking device; and a formation for engaging the blocking member when the blocking member is in its blocking position to prevent the connecting member moving outside of the pre-determined use condition or below the minimum angle Θm, wherein the blocking member is provided on one of the connecting member and the floor head, and the formation is provided on the other of the connecting member and the floor head.

The formation may include a recess and the blocking member may include an engagement portion that extends into the recess when the blocking member is in its blocking position.

The formation may be provided on the rotatably supported portion.

The angle Θ may be at least 45°, preferably 50° and most preferably 55°, or the minimum angle Θm may be 45°, preferably 50° and most preferably 55°.

The blocking device may block all movement of the connecting member when the blocking device is in its blocking condition.

The tool may include a further blocking device for inhibiting pivotal movement of the connecting member away from an upright storage condition.

According to an aspect of the invention we provide a tool for a surface cleaning apparatus, including:

a floor head including a floor facing surface which defines an inlet for receiving dirt-laden air, which inlet is generally positioned in a first plane P;

a passage for carrying dirt-laden air from the floor head to the apparatus;

a connecting member or a part thereof having an elongate axis C for connecting the tool to a surface cleaning apparatus, wherein the floor head and connecting member are pivotally connected about an axis A; and a blocking device for inhibiting pivotal movement of the connecting member about axis A, wherein the blocking device is moveable to a blocking position in which the blocking device inhibits movement of the connecting member such that a minimum angle Θm between the elongate axis C and the floor surface is at least 35° and movement of the connecting member is permitted such that the angle Θm may be greater than 35° whilst the blocking device is in its blocking position.

According to an aspect of the invention we provide a tool for a surface cleaning apparatus, including:

a floor head including a floor facing surface which defines an inlet for receiving dirt-laden air, which inlet is generally positioned in a first plane P;

a passage for carrying dirt-laden air from the floor head to the apparatus;

a connecting member or a part thereof having an elongate axis C for connecting the tool to a surface cleaning apparatus, wherein the floor head and connecting member are pivotally connected about an axis A; and a blocking device for inhibiting pivotal movement of the connecting member about axis A, wherein the blocking device is moveable to a blocking position in which the blocking device inhibits movement of the connecting member such that a minimum angle Θm between the elongate axis C and the first plane P is at least 35° and movement of the connecting member is permitted such that the angle Θm may be greater than 35° whilst the blocking device is in its blocking position.

According to an aspect of the invention we provide a tool for a surface cleaning apparatus, including:

a floor head including a floor facing surface which defines an inlet for receiving dirt-laden air, which inlet is generally positioned in a first plane P;

a passage for carrying dirt-laden air from the floor head to the apparatus;

a connecting member or a part thereof having an elongate axis C for connecting the tool to a surface cleaning apparatus, wherein the floor head and connecting member are pivotally connected about an axis A;

a first blocking device for inhibiting pivotal movement of the connecting member away from an upright storage condition; and a second blocking device for inhibiting pivotal movement of the connecting member about axis A, wherein the second blocking device is moveable to a blocking position in which the blocking device inhibits movement of the connecting member such that a minimum angle Θm between the elongate axis C and the floor surface is at least 35°.

According to an aspect of the invention we provide a tool for a surface cleaning apparatus, including:

a floor head including a floor facing surface which defines an inlet for receiving dirt-laden air, which inlet is generally positioned in a first plane P;

a passage for carrying dirt-laden air from the floor head to the apparatus;

a connecting member or a part thereof having an elongate axis C for connecting the tool to a surface cleaning apparatus, wherein the floor head and connecting member are pivotally connected about an axis A;

a first blocking device for inhibiting pivotal movement of the connecting member away from an upright storage condition; and a second blocking device for inhibiting pivotal movement of the connecting member about axis A, wherein the second blocking device is moveable to a blocking position in which the second blocking device inhibits movement of the connecting member such that a minimum angle Θm between the elongate axis C and the first plane P is at least 35°

The first blocking device may be moveable to a blocking condition in which pivotal movement of the connecting member downwardly outside of a pre-determined use condition is inhibited.

When the second blocking device is in its blocking position, movement of the connecting member may be permitted such that the angle Θm may be greater than 35° whilst the second blocking device is in its blocking position.

The blocking device/second blocking device may include:

a blocking member moveable between blocking and non-blocking positions which correspond to blocking and non-blocking conditions of the blocking device; and a formation for engaging the blocking member when the blocking member is in its blocking position to prevent the connecting member moving outside of the pre-determined use condition or below the minimum angle Θm, wherein the blocking member is provided on one of the connecting member and the floor head, and the formation is provided on the other of the connecting member and the floor head.

The formation may include a recess and the blocking member includes an engagement portion that extends into the recess when the blocking member is in its blocking position.

The formation may be provided on the rotatably supported portion.

The angle Θ in the predetermined use condition may be between 35° and 85°, or between 45° and 85°, or between 55° and 85,° or between 50° and 60°.

The blocking device/second blocking device may block all movement of the connecting member when the blocking device/second blocking device is in its blocking condition.

A part/the blocking member of the blocking device/second blocking device may have a user-graspable portion for the user to move the blocking member into and out of its blocking condition.

The user-graspable portion may be accessible from the floor facing surface of the tool.

The floor facing surface may include a recess within which at least a part of the blocking device/second blocking device is positioned.

The recess may be positioned rearwardly of the floor facing inlet.

According to a fourth aspect of the invention we provide a surface cleaning apparatus including a tool of any preceding aspect.

The apparatus may be a cylinder type cleaner having an inlet for dirt-laden air.

The apparatus may include a handheld cleaner having an inlet for dirt-laden air.

The surface cleaning apparatus may include an elongate portion having first and second opposite ends, wherein the elongate portion defines a passage for receiving dirt-laden air and wherein:

the first end of the elongate portion is for connection to an inlet of the apparatus; and the second end of the elongate portion is for connection to the connecting member.

The elongate portion or a part thereof may have an axis which is co-axial with the axis C when the elongate portion is connected to the connecting member.

BRIEF DESCRIPTION OF THE DRAWINGS

Embodiments of the invention will be set out below by way of example only with reference to the accompanying figures, of which.

DETAILED DESCRIPTION

Figure 1:
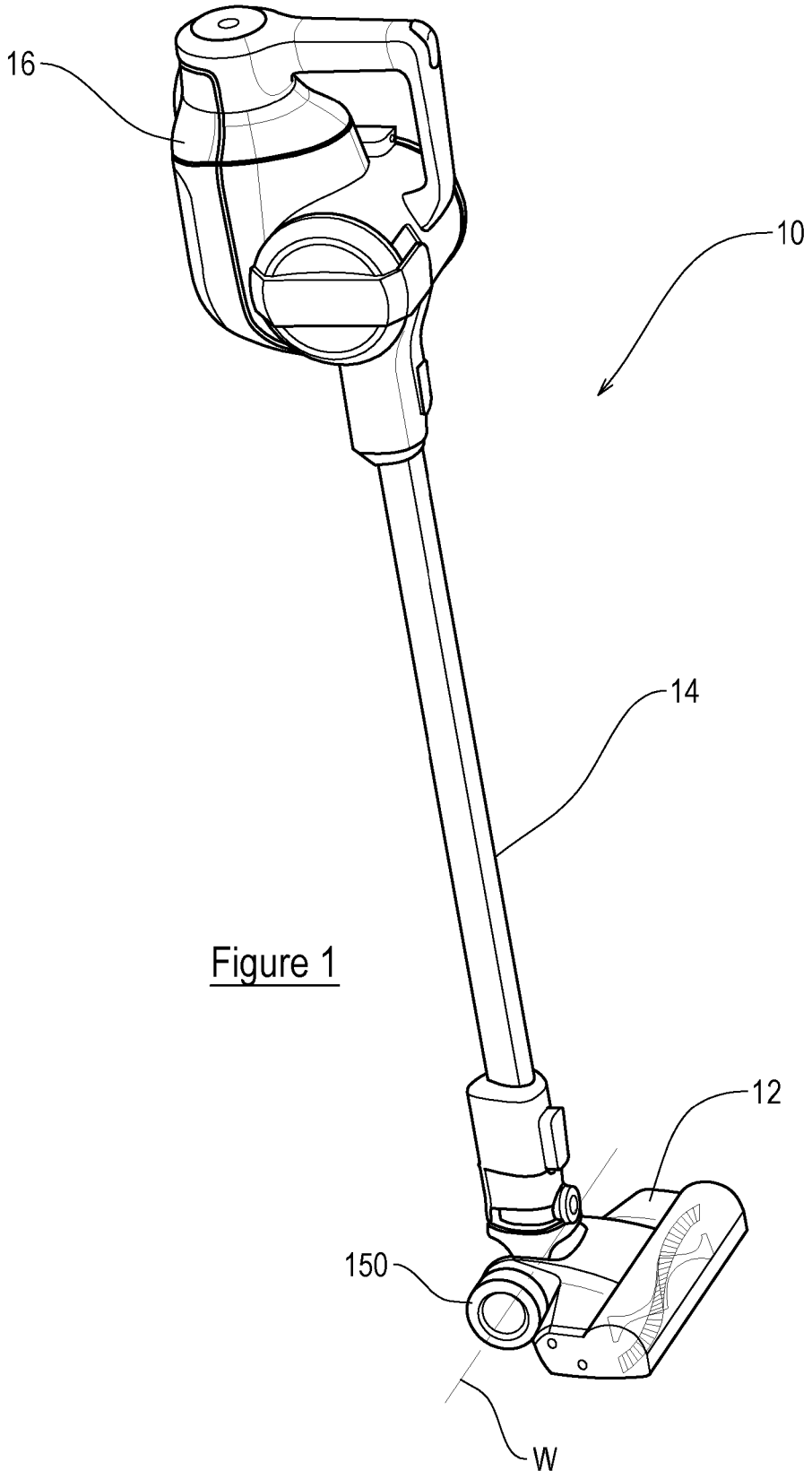
FIG. 1 is a perspective view of a surface cleaning apparatus.
Figure 2:
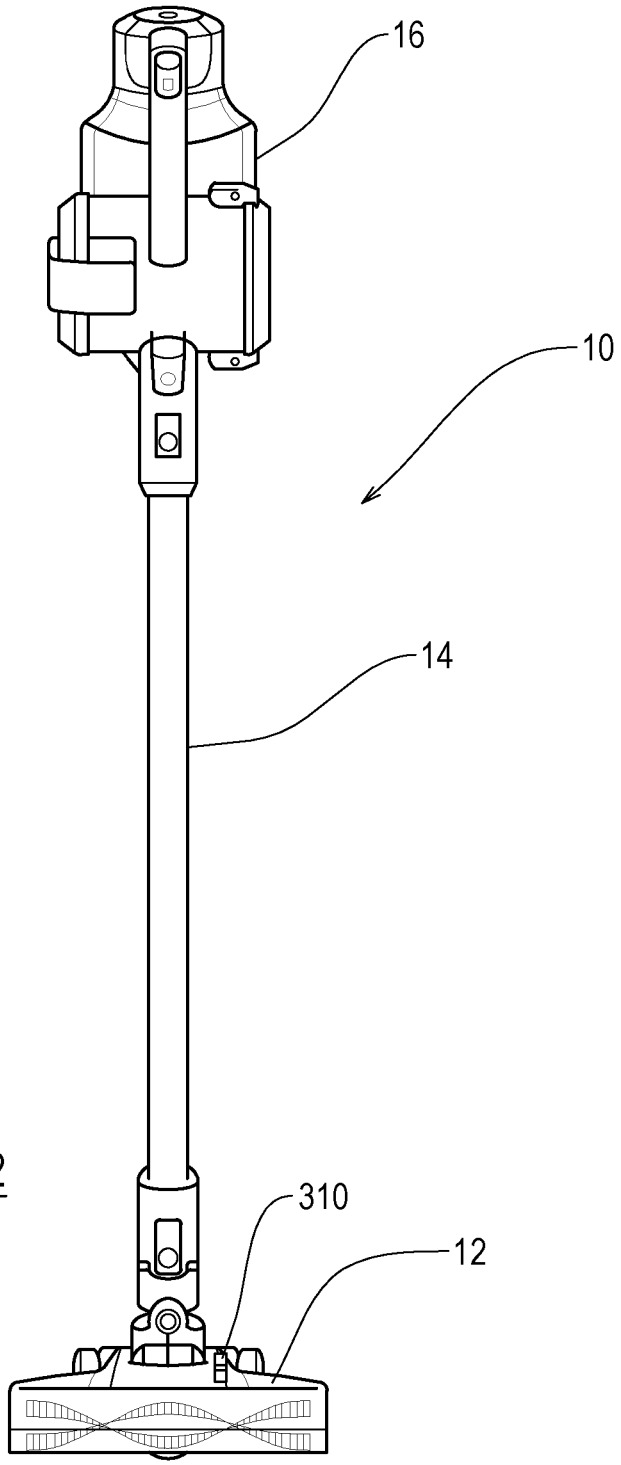
FIG. 2 is a front view of the apparatus of FIG. 1.

Referring to the figures, these show a surface cleaning apparatus 10 in accordance with the present invention. The apparatus 10 includes a tool 11 with a floor head 12, a housing 16 and an elongate member 14 connecting the floor head 12 to the housing 16. The floor head 12 has a housing defining a space for component parts of the floor head 12. The housing defines a floor facing surface S and a floor facing inlet 13 for receiving dirt-laden air. The inlet 13 extends widthwise of the floor level 12. The floor facing surface S is generally planar and the inlet 13 is positioned in a first plane P. The housing 16 in this example is operable as a handheld surface cleaning apparatus, commonly known as a hand vac, when the elongate member 14 and floor head 12 are not connected thereto. The housing 16 supports a suction source, a dirt container 18 and a cyclonic separator. In this example the suction source is an electric motor driving a rotatable fan, but any appropriate suction source may be used. All that is necessary is for the suction source to be able to draw air through the floor head 12 and elongate member 14 towards the dirt collection container.

In this example the housing 16 supports or contains a battery to provide electrical power to the suction motor and other components of the apparatus 10. In alternative embodiments, the apparatus 10 may be mains powered.

Whilst in the present embodiment the apparatus 10 includes a cyclonic separator to separate dirt from the air flowing through the apparatus 10, this is not essential. Indeed, embodiments are envisaged where the apparatus 10 includes a filter bag which collects dirt, or any other appropriate device to separate the dirt from the air. The apparatus 10 includes a pivotally moveable door 18*a* which enables a user to empty dirt collected within the container 18.

The elongate member 14 includes a passage for carrying dirt-laden air from the floor head 12 to the dirt collection container 18. In this embodiment, elongate member 14 is made from a rigid material. The floor head 12, in this example, includes a cleaning member 15 which is rotatably supported in the floor head 12. In this embodiment, the cleaning member 15 is a floor agitating member or brush having a plurality of cleaning elements. The cleaning member 15 extends width wise of the floor head 12. The cleaning member 15 is positioned in the inlet 13 and a portion of the cleaning elements extend through the inlet 13. The floor head 12 includes a motor for driving the cleaning member 15 so the elongate member 14 includes a further passage through which electrical cables may extend to provide an electric connection between the housing 16 and the motor in the floor head 12.

In embodiments, the floor head 12 may have an elongate blade or strip (not shown) which extends across the width of the floor head 12. The blade or strip may be made from a resilient material, e.g. rubber, for supporting the floor head 12 on a hard floor surface and to space the inlet 13 from the surface. In embodiments, the elongate blade or strip may be part of the floor head 12 without or in addition to the agitating member or brush. Embodiments may further, in addition to the cleaning member and/or elongate blade/strip, include the floor head 12 supporting a strip of felt or felt-like material on its floor facing surface. The strip may be positioned rearwardly of the inlet 13 and extend widthwise across the floor head 12.

The floor head 12 is disconnectable from the elongate member 14, so that, for example, another tool can be connected to the free end of the elongate member 14. The elongate member 14 is also disconnectable from the housing 16, e.g. by way of a manually operated switch 17. This enables the housing 16 to be used as a handheld surface cleaning apparatus, with the option of being able to connect another tool to the location from where the elongate member 14 is removed.

The housing 16 includes a handle for holding the apparatus 10, said handle including first 20 and second 21 user-graspable portions which are connected to each other substantially at right-angles. A first end of the first user-graspable portion 20 is connected to the housing 16 and extends generally rearwardly away therefrom and from the elongate member 14. A first end of the second user-graspable portion 21 is connected to the housing 16 and extends generally upwardly therefrom. Respective second ends of the first 20 and second 21 user-graspable portions are connected to each other. Essentially, the first 20 and second 21 user-graspable portions form a handle which is L-shaped and which provides two locations each of which is sized such that it can be grasped fully by a hand of a user. A device 22, e.g. a switch, for turning the apparatus "on" is positioned at the connection of the second ends of the first 20 and second 21 user-graspable portions to each other.

FIGS. 6 to 15 focus on features of the tool 11, its floor head 12 and their interaction with the elongate member 14. The tool 11 includes a connecting member, indicated generally at 200, for connecting the tool 11 to an end of the elongate member 14. The connecting member 200 includes an articulated joint having first and second parts 201, 202 which are pivotable relative to each other about an axis B, which in this example, is perpendicular to the elongate axis of the elongate member 14 and the widthwise dimension of the tool 11. The floor head 12 and the second part 202 of the connecting member are pivotally connected to each other about an axis A which extends transversely, in this example perpendicularly, to axis B. The inlet 13 and the cleaning member 15 are positioned forwardly of axis A.

The tool 11 also includes a passage 203 for carrying dirt-laden air from the floor head 12 to the housing 16, which, in this example, is in the form of a corrugated tube. In embodiments, other forms of passage may be used. The tool 11 also includes an electrical cable passage through which electrical wires 204, 205 extend to provide an electric connection between the housing 16 (e.g. a battery housed therein) and an electrical component in the floor head 12. In this example, the electric connection is to the motor that drives rotation of the cleaning member 15. Thus, electrical power is provided to the motor in the floor head 12 by way of the wires 204, 205.

The floor head 12 includes a pair of rearwardly extending housing members 218, 219 which are spaced apart to define a space for passage 203 to pass therethrough. The members 218, 219 extend rearwardly away from the floor facing inlet. The floor head 12 includes first and second support members 150, which, in embodiments are wheels rotatably mounted to respective housing members 218, 219 about an axis W. Axis W is spaced apart from axis A and is positioned rearwardly of axis A. Support members 150 are spaced apart and positioned to respective sides of the connecting member 200.

Figure 8:
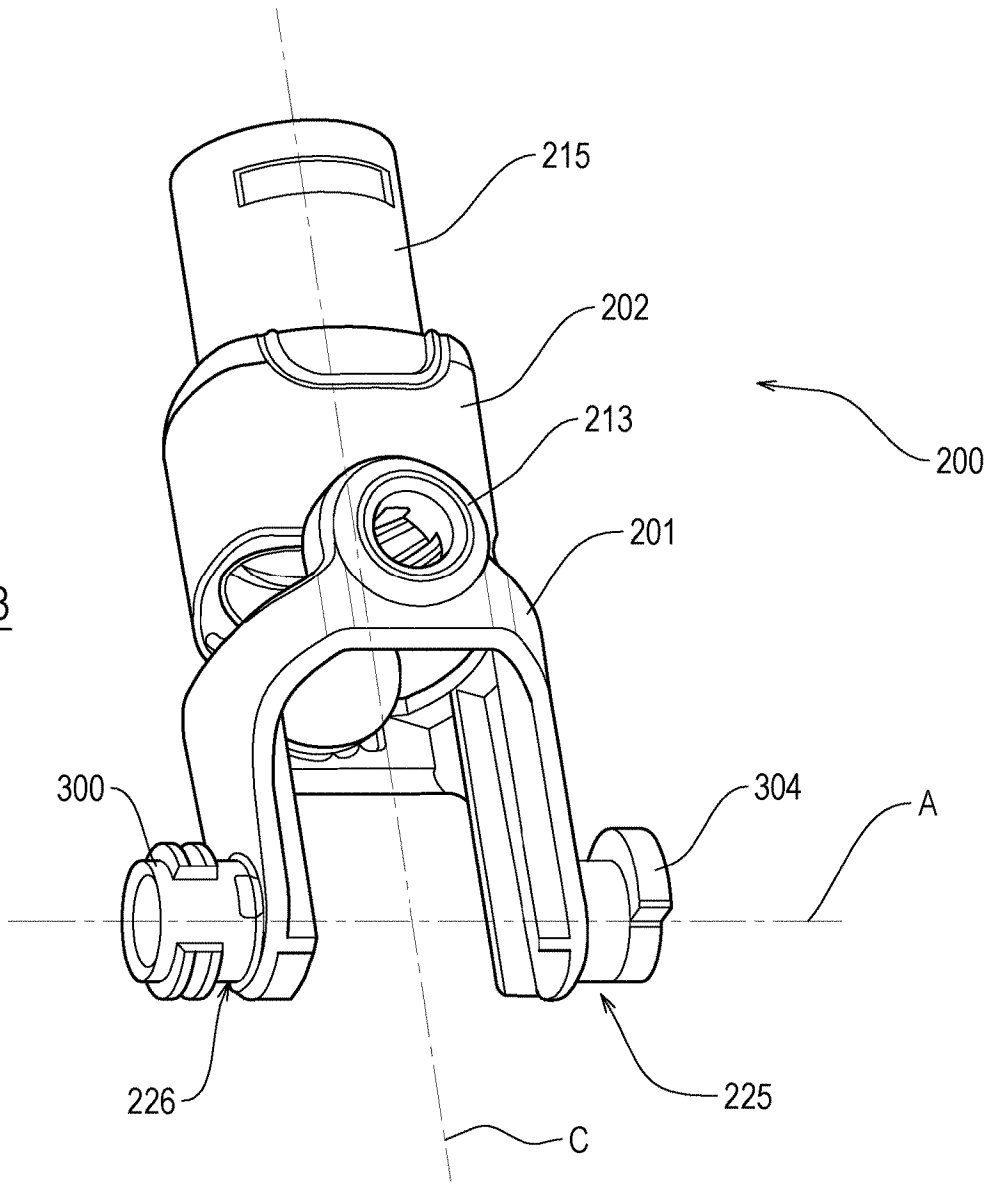
FIG. 8 is a perspective view of component parts of the tool of FIG. 6.
Figure 9:
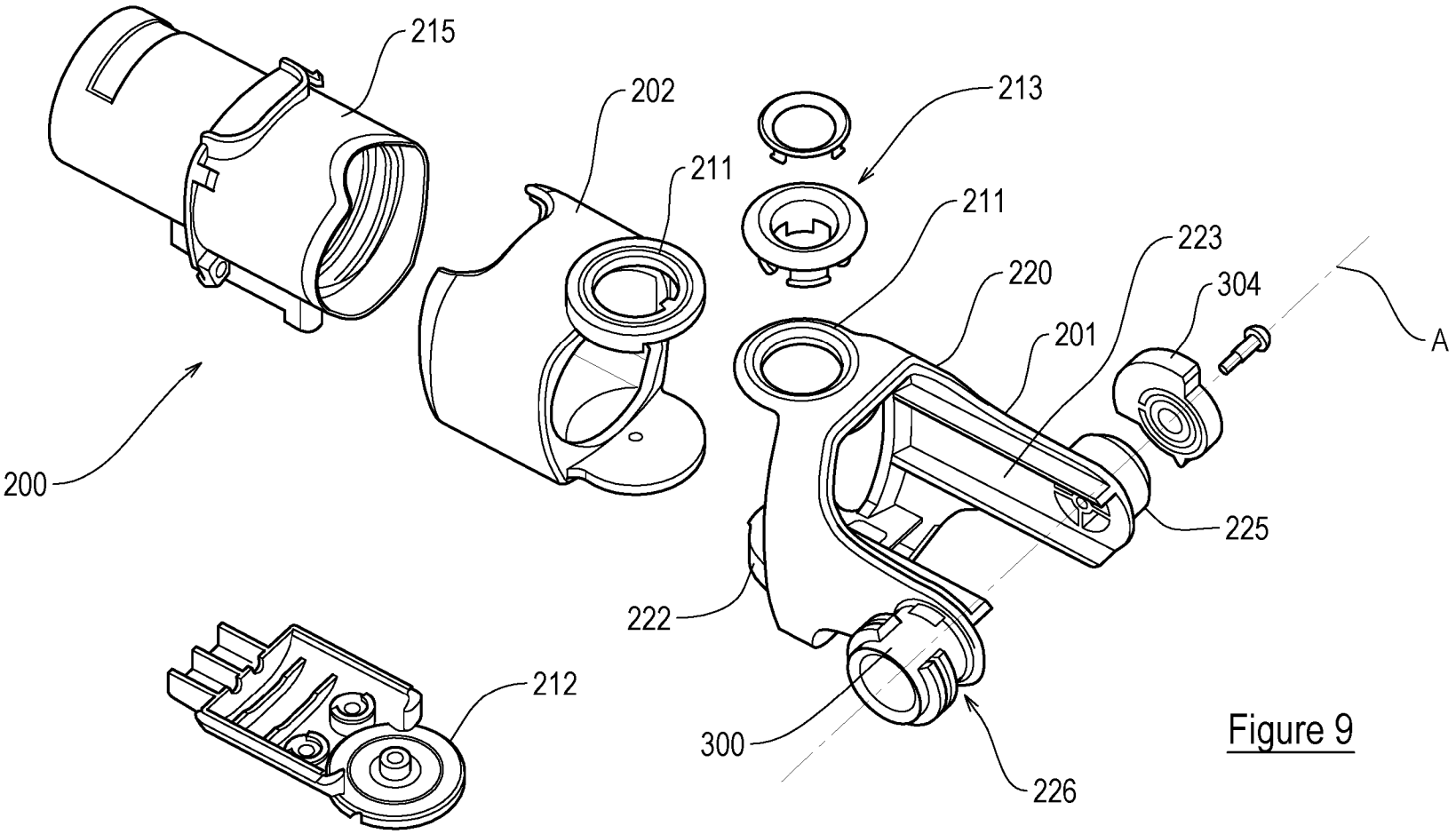
FIG. 9 is an exploded perspective view of the components shown in FIG. 8.

FIGS. 8 and 9 show various component parts which make up the connecting member 200. In more detail, the first part 201 is generally n-shaped when viewed from the rear or front of the tool 11. The connecting member 200 has an elongate axis C which, when the connecting member 200 is connected to the elongate member 14, is aligned with the elongate axis of the elongate member 14. The angle between C and the plane P is denoted as e, measured rearwardly from the axis C towards the plane P.

First part 201 has downwardly extending leg portions 223, 224 which are spaced from each other along axis A to permit the passage 203 to pass therebetween. Each portion 223, 224 is provided with a generally cylindrical projection 225, 226 which extends outwardly of its respective portion 223, 224 and is received in a corresponding opening provided by the respective housing member 218, 219 of the floor head 12. The projections 225, 226 extend in opposite directions along axis A. The projections 225, 226 facilitate the pivoting of the floor head 12 relative to the connecting member 200 about the axis A. An opposite end 220 of the first part 201, i.e. opposite to the end on which projections 225, 226 are provided, is provided with formations 221, 222 which are spaced from each other along axis B and which provide one half of the articulation between the first 201 and second 202 parts.

With reference to FIG. 9, the second part 202 is generally cylindrical with an opening to receive the passage 203. An end of the second part 202 which faces the first part 201 is provided with formations 211, 212 which are spaced from each other along axis B and which provide the other half of the articulation between the first 201 and second 202 parts. The formation 212 is connected to the formation 222 by a fastener. The formation 211 is connected to the formation 221 by a connector 213, which provides a snap-fit. Additionally, the connecting member 200 includes a part 215 which is shaped to provide a releasable connection to the elongate member 14. Essentially, the part 215 is a sub-part of the second part 202 of the connecting member 200.

Figure 3:
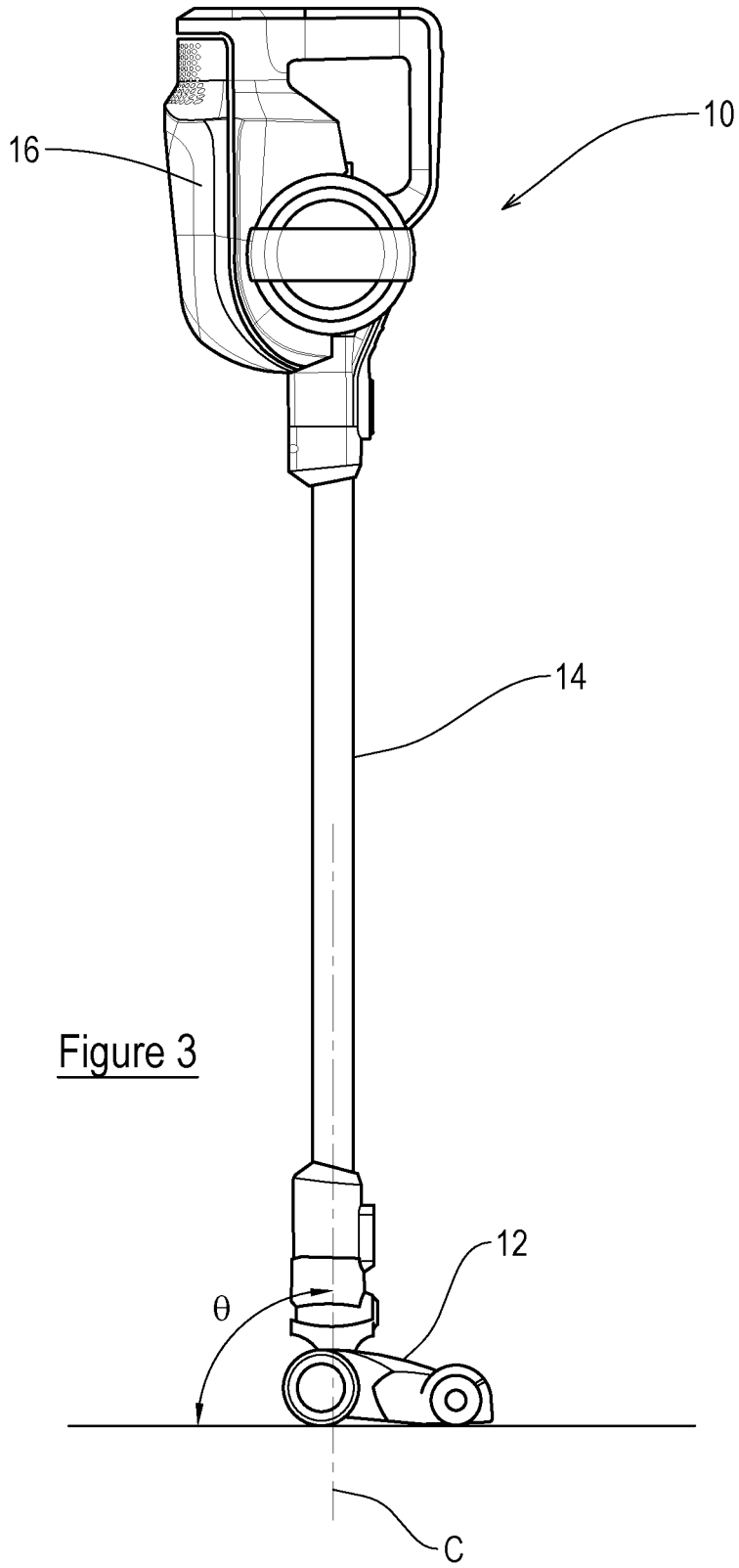
FIG. 3 is a side view of the apparatus of FIG. 1.
Figure 4:
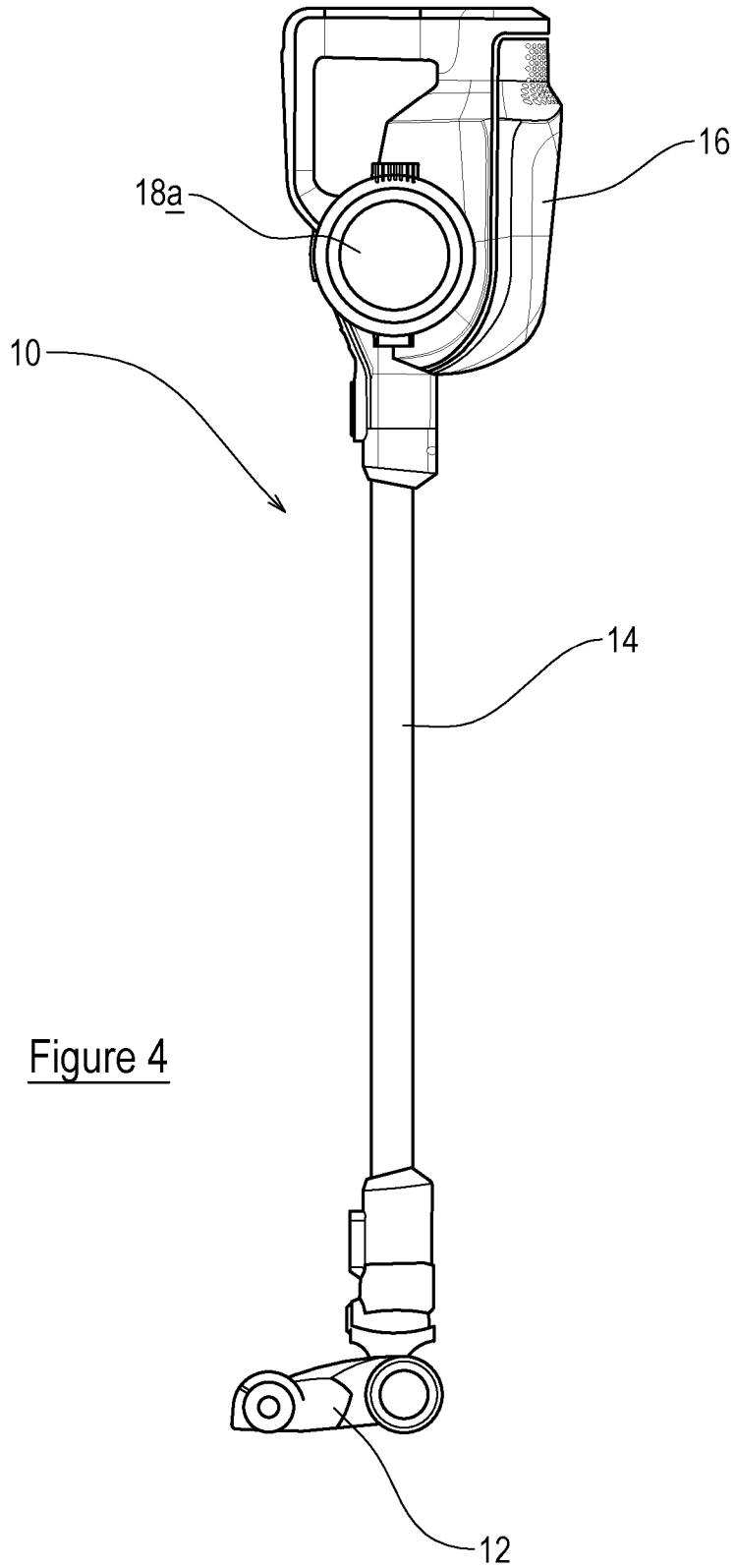
FIG. 4 is an opposite side view of the apparatus of FIG. 1.
Figure 5:
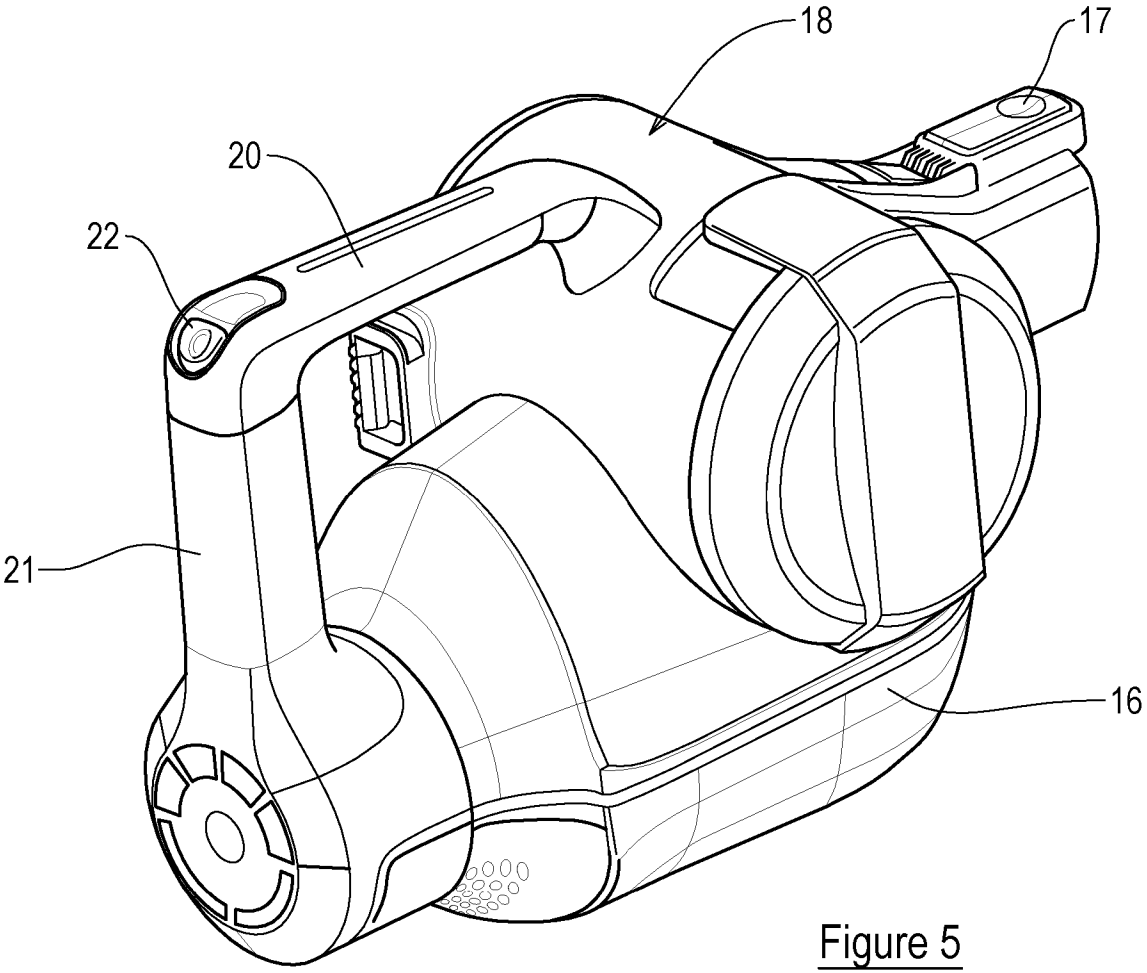
FIG. 5 is a perspective view of a housing of the apparatus of FIG. 1, which housing is operable as a handheld surface cleaning apparatus.
Figure 6:
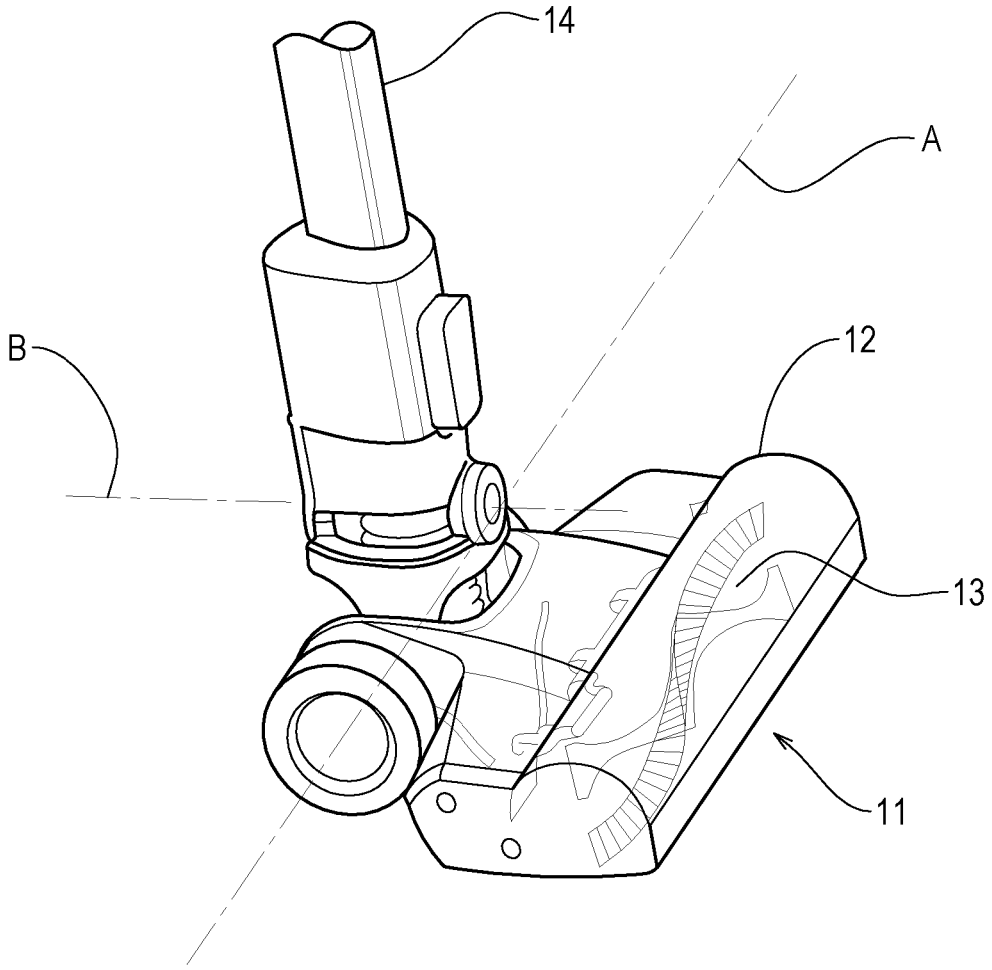
FIG. 6 is a perspective view of a tool of the apparatus.
Figure 7:
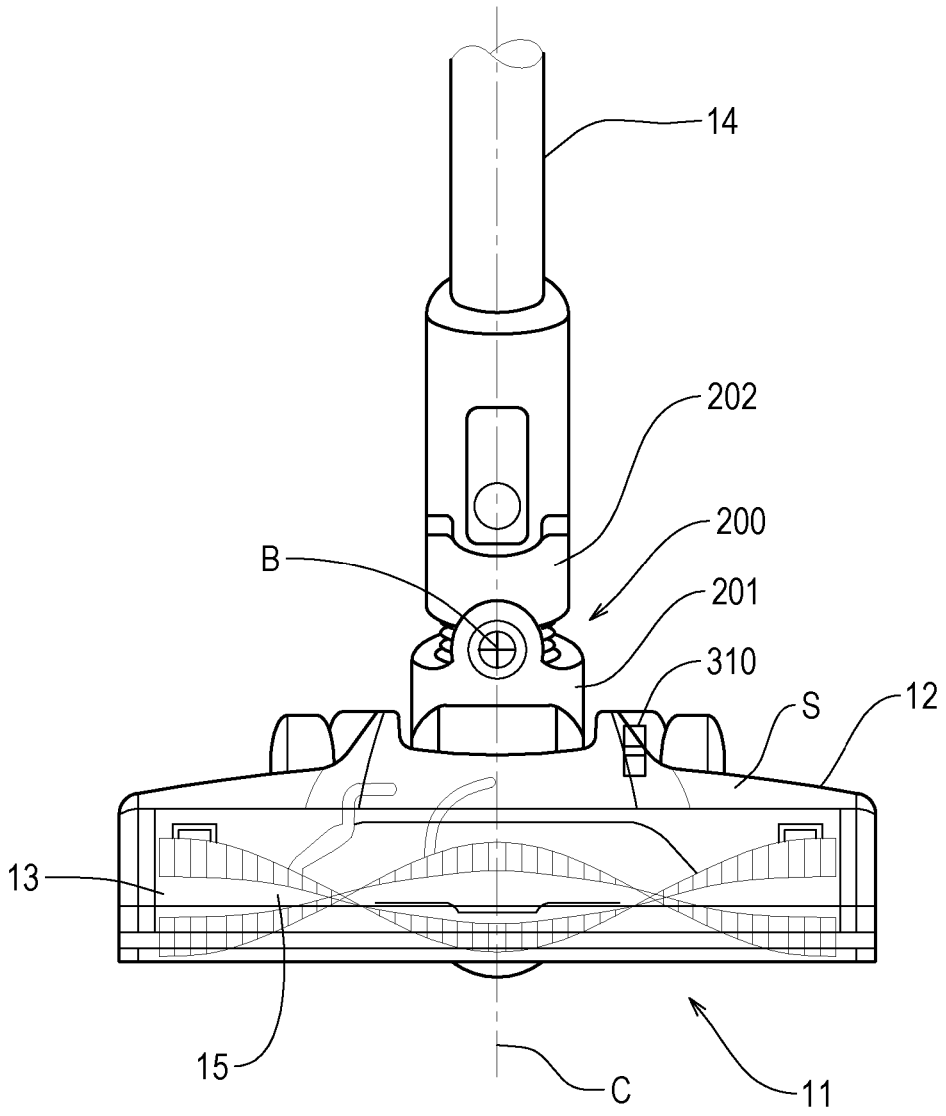
FIG. 7 is a front view of the tool of FIG. 6.
Figure 10A:
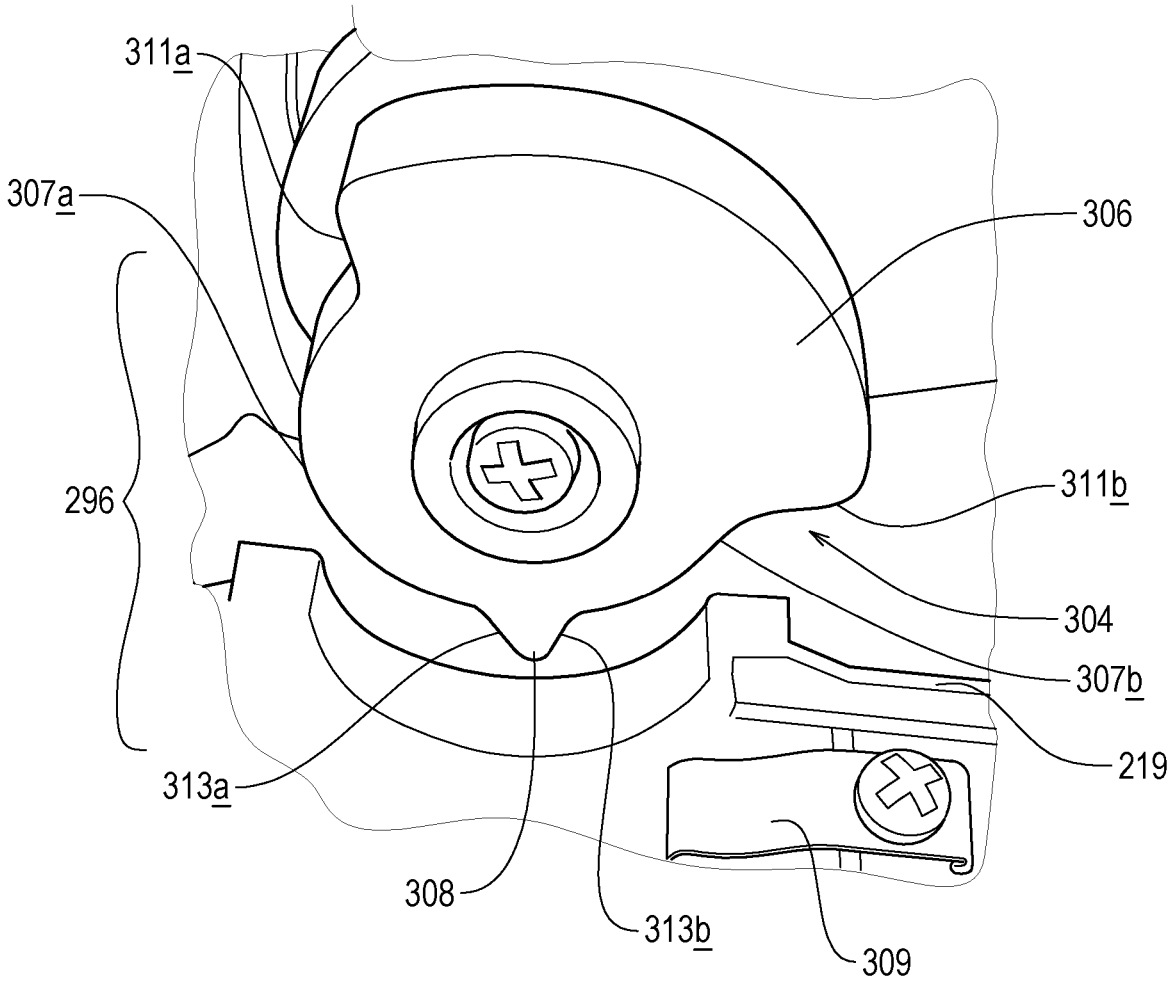
FIGS. 10*a* and 10*b* are perspective views of certain component parts of the tool.
Figure 10B:
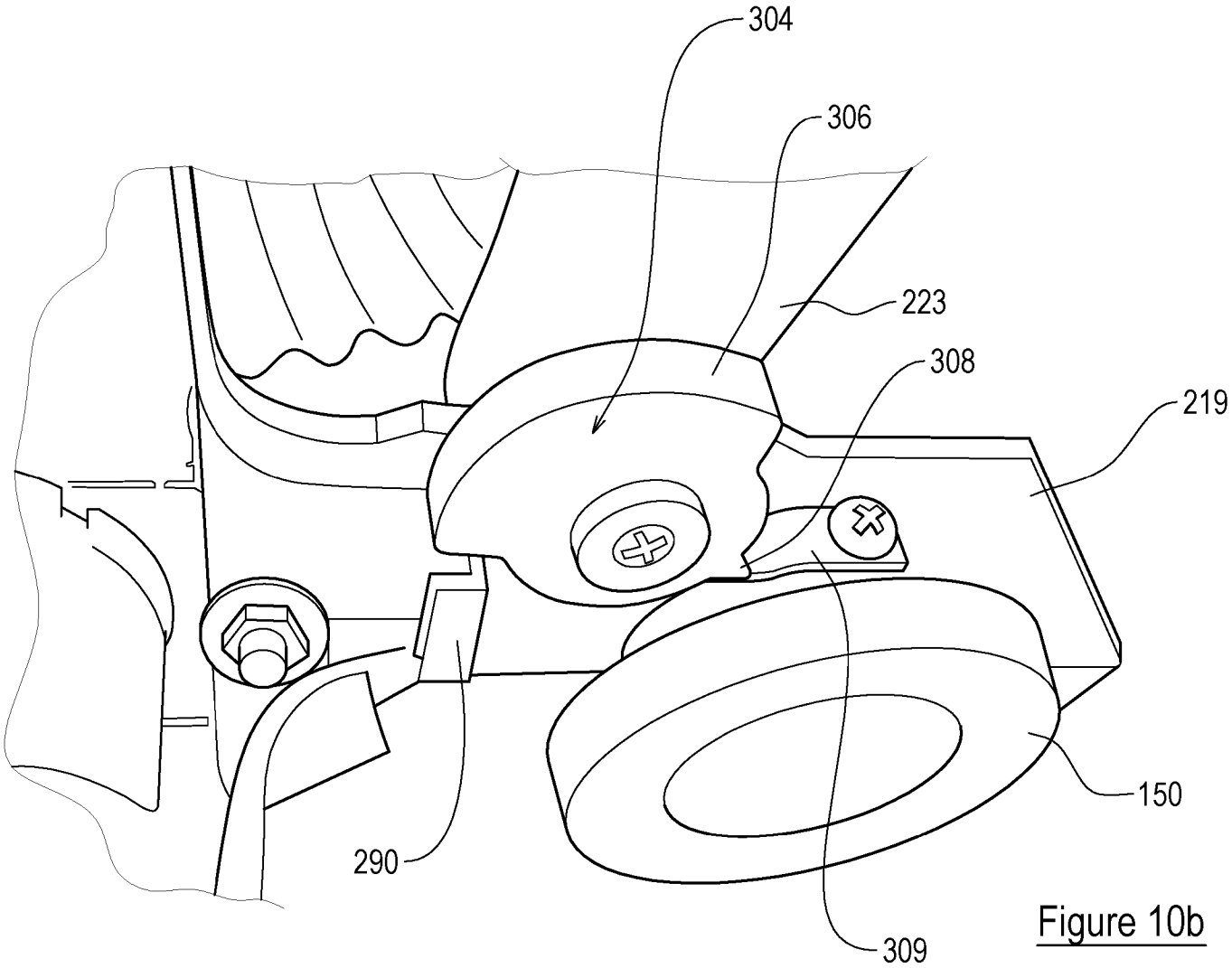
Figure 11:
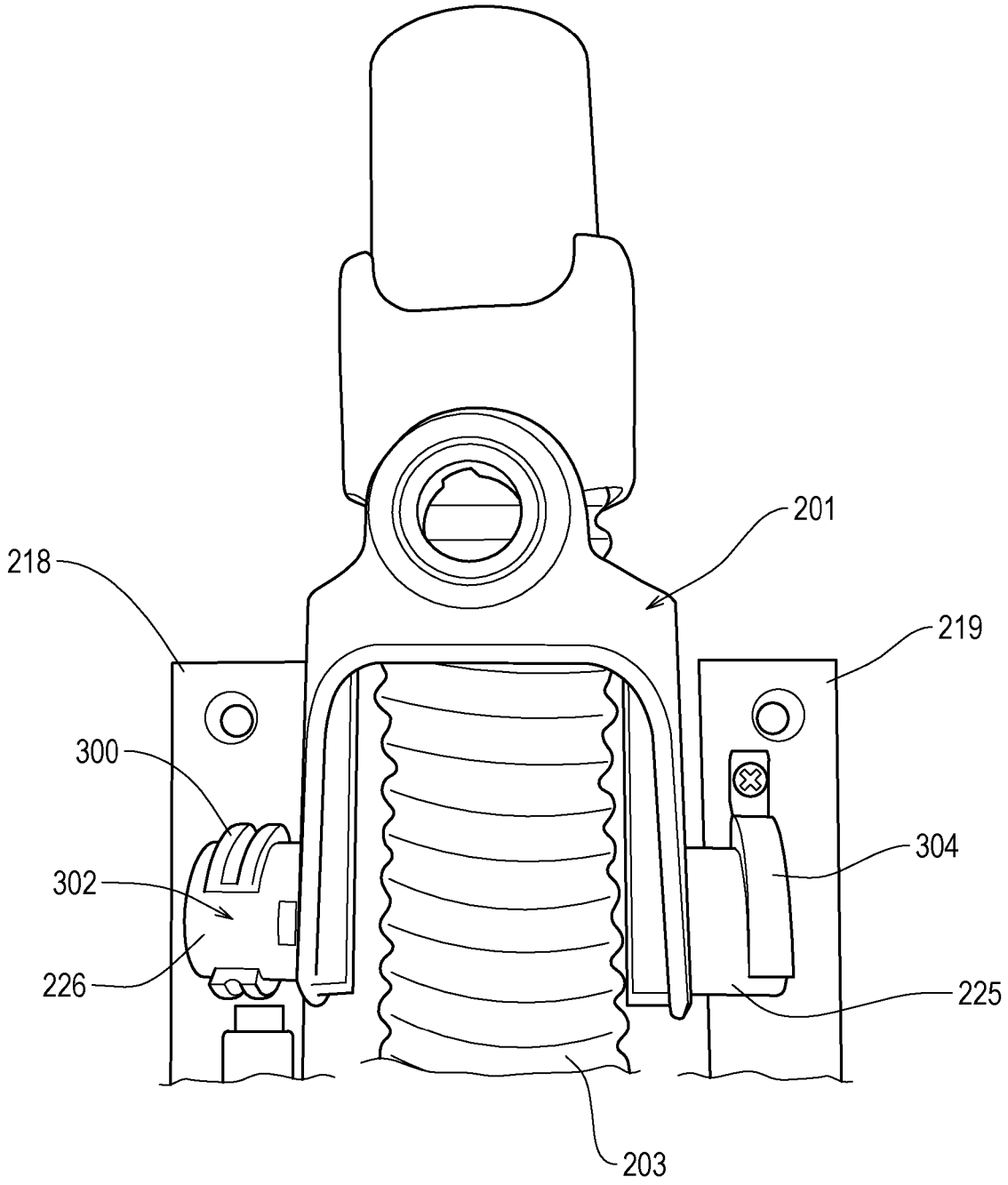
FIG. 11 is a plan view of certain component parts of the tool.

As best seen in FIGS. 10*a* and 10*b*, the tool 11 includes a first blocking device 296. The first blocking device 296 is for inhibiting pivotal movement of the connecting member 200 away from an upright storage condition. When the connecting member 200 is in the upright storage condition, the surface cleaning apparatus 10 is held by the first blocking device 296 in a generally upright position of the surface cleaning apparatus 10 as shown in FIG. 3. The present apparatus not capable of self-standing (i.e. unsupported) but it could be.

The first blocking device 296 is configured to be moveable between blocking and non-blocking conditions as will be described.

The first blocking device 296 includes a formation 304 and first and second blocking formations 290, 309 configured to engage the formation 304 when the first blocking device 296 is in its blocking condition. Housing member 219 defines a recess which is open at an upper end thereof to receive the formation 304 partially therein.

Formation 304 lies in a plane parallel to the plane in which axis C lies. Formation 304 is attached to a free end of projection 225 and thereby connected to portion 223. Rotation of portion 223 causes a corresponding rotation of formation 304 about axis A.

Formation 304 has a generally circular shape with an arcuate sector which is of a larger radius than the rest of the shape. Formation 304 includes a first radially extending portion 306 that extends part of the circumference around the formation 304. Portion 306 extends generally upwardly. Formation 304 includes a second, smaller, radially extending portion 308 circumferentially spaced apart from the first portion 306. Portion 308 is generally tooth-shaped in side view and extends generally downwardly. Thus, the first and second portions 306, 308 define first and second recesses 307*a*, 307*b* which extend between them.

The first blocking formation 209 is engageable with the formation 304 to limit rotation of the formation 304 in a forward direction towards the floor surface, preferably to inhibit Θ being greater than 90°. In embodiments this angle may be different depending on the required upright position of the surface cleaning apparatus. Second blocking formation 309 is engageable with the formation 304 to limit rotation of the formation 304 in a rearward direction towards the floor surface, preferably to inhibit Θ being less than 90°. In embodiments this angle may be different depending on the required upright position of the surface cleaning apparatus.

First blocking formation 290 is formed as a boss that extends upwardly from a base wall of the housing member 219 of which it is an integral part. In embodiments, the first blocking formation 219 may be configured differently and may not be an integral part of the housing member 219. Formation 290 is positioned forwardly to one side of the formation 306 and is configured for abutment with the first portion 306 when the formation 304 is rotated forwardly to Θ=90°. In this position, the formation 290 prevents movement of the formation 304 therepast in a forward direction.

Second blocking formation 309 is made from a resiliently deformable material. In this example, formation 309 is a thin elongate metal strip. Second blocking formation 309 is attached to a lower wall of the recess and is shaped for selective engagement with the portions 306, 308 as the formation 304 rotates, as will be described. In embodiments, the second blocking formation 309 may be formed as a non-metallic member.

Figure 12A:
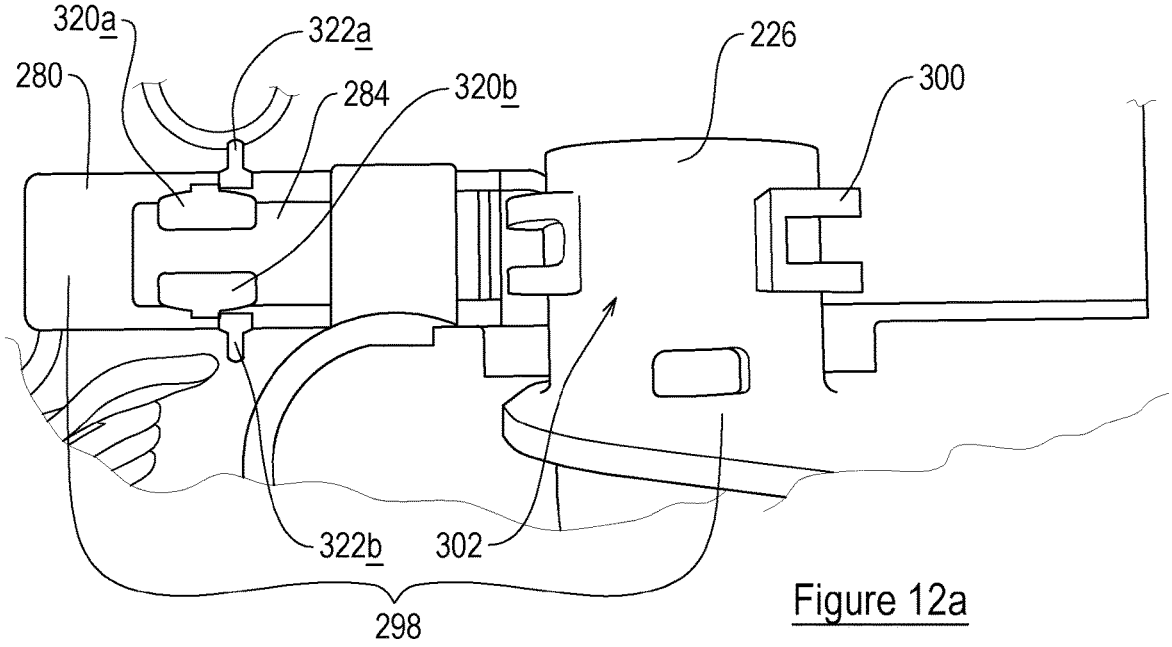
FIGS. 12*a*-12*b* are plan views showing certain component parts of the tool in different states of operation.
Figure 12B:
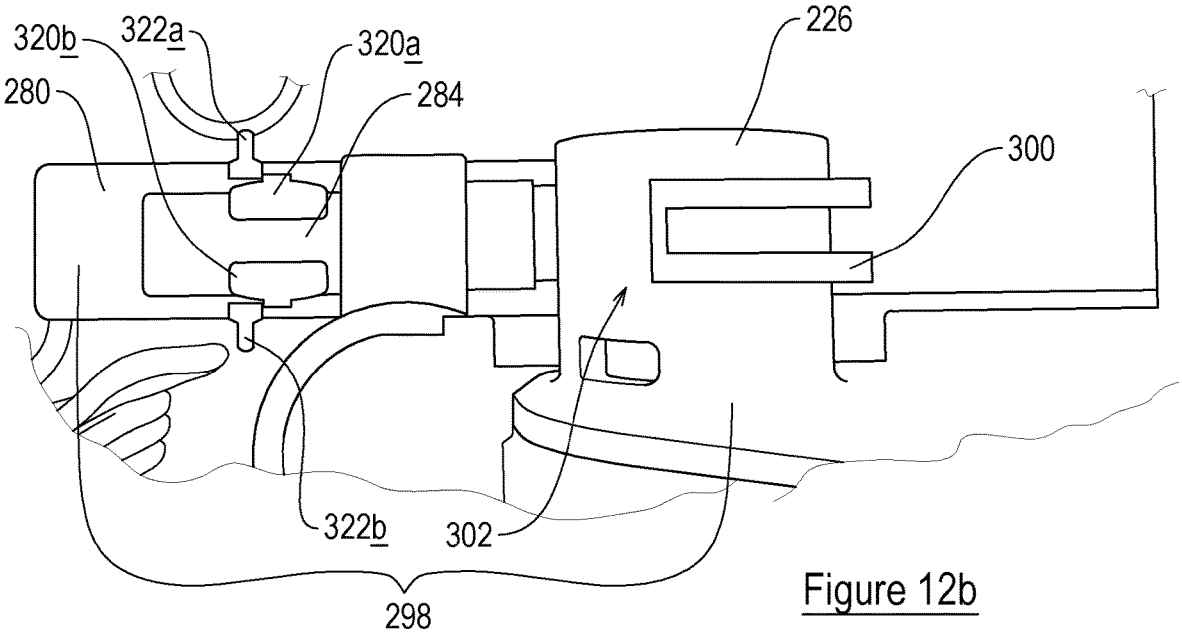
Figure 13A:
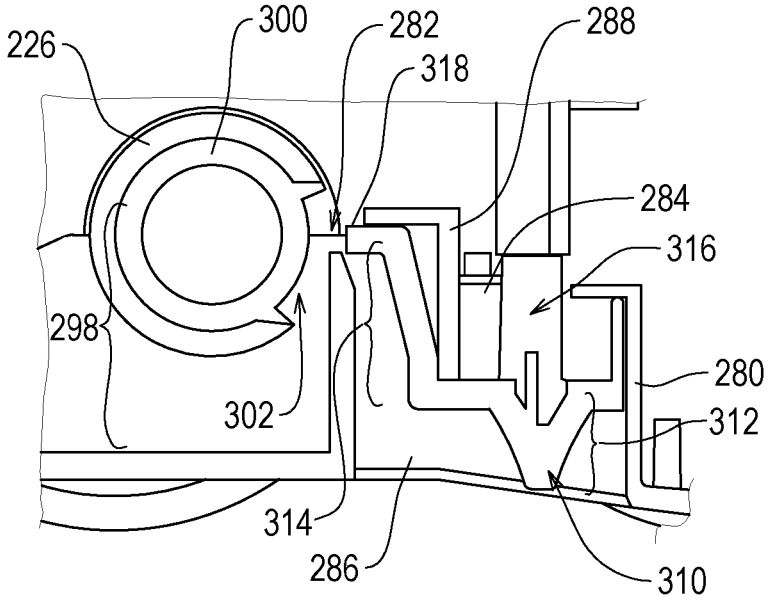
FIGS. 13*a* and 13*b* are cross-section side views of certain component parts of the tool in different states of operation.

The tool 11 includes a second blocking device 298 which is best seen in FIGS. 12*a*-12*b* and 13*a*-*c*. As will be explained in more detail below, the second blocking device 298 can be moved between blocking (FIGS. 12*b* and 13*b*) and non-blocking conditions (FIGS. 12*a* and 13*a*). In the blocking condition, the second blocking device 298 inhibits pivotal movement of the connecting member 200 about axis A outside of a pre-determined use condition. The pre-determined use condition is herein defined to mean that, during use, the connecting member 200 is inclined relative to the floor surface such that the tool 11 can be moved along the floor surface to clean the floor surface by pushing or pulling the elongate member 14. In embodiments, the condition may encompass a single angle of inclination of the connecting member 200 relative to plane P or a range of angles of inclination through which the connecting member 200 may be moveable about axis A.

Figure 13B:
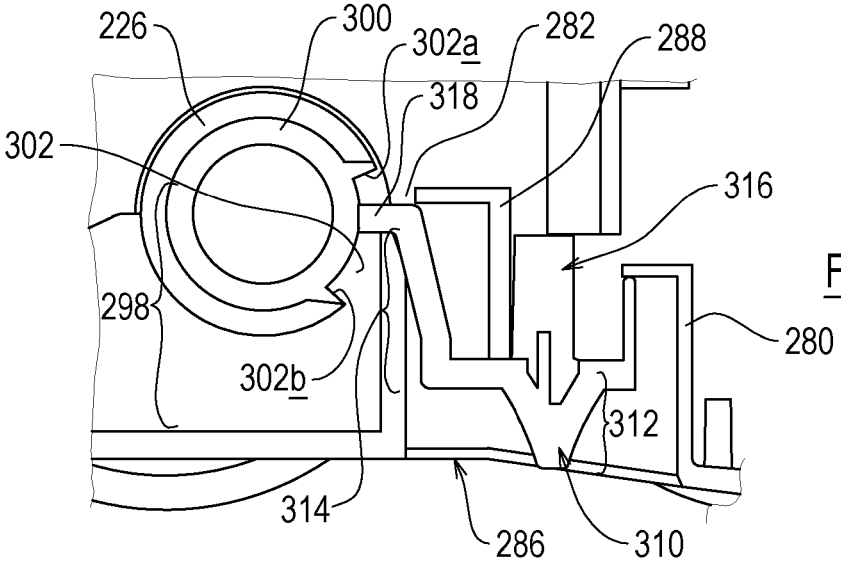
Figure 13C:
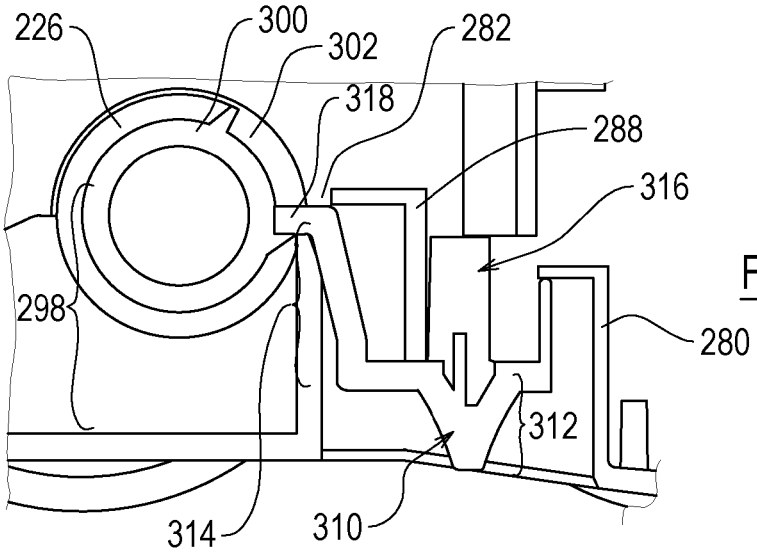

As best seen in FIGS. 13*a-c*, the second blocking device 298 includes a blocking member 310 moveable between blocking and non-blocking positions which correspond to blocking and non-blocking conditions of the blocking device. Second blocking device 298 also includes a formation 300 for engaging the blocking member 310 when the blocking member 310 is in its blocking position to inhibit movement of the connecting member 200 such that an angle Θm between the elongate axis C and the first plane P is at least 35°. In embodiments, movement of the connecting member is permitted such that the angle Θm may be greater than 35° whilst the blocking device is in its blocking position.

In the present embodiment, the first plane P is coincident with a plane in which the floor surface lies. In other embodiments, the first plane P may not be coincident and the angle Θm then corresponds to the angle between the elongate axis C and the floor surface, as measured in a rearward direction.

As best seen in FIGS. 12*a*-12*b*, formation 300 is provided on the connecting member 200 and the blocking member 310 is provided on the floor head 12. In embodiments, these may be provided differently and an alternatively configured blocking member may be part of the connecting member 200 whilst a formation for engaging the blocking may be provided on the floor head 12. For example, the blocking member 310 may be a projection that can be moved relative to the connecting member 200 between extended and retracted positions for engagement with the formation 300.

In the embodiment shown, the formation 300 is provided on projection 226. Formation 300 extends circumferentially around and radially away from the outwardly facing surface of the projection 226 to define a circumferential recess 302. In this embodiment, formation 300 is formed as an integral part of the first part 201. In embodiments, formation 300 may be a separate component part that is connected to the first part 201. All that is required for certain embodiments is that the projection 226 includes a circumferential recess 302 and is moveable with the first part 201 for engagement with the blocking member 310.

In this embodiment, with reference to FIGS. 13*a*-13*c*, the second blocking device 298 includes a formation 280 formed as an integral part of the floor head 12 and which is positioned forwardly of the projection 226. Formation 280 has a floor facing surface that defines a recess for receiving the blocking member 310 therein. The formation 280 has an upper end portion which defines first and second openings 282, 284 and a lower end portion which defines a third opening 286. Formation 280 includes a central wall 288 which defines part of the openings 282, 284. First and second openings 282, 284 are spaced apart in a lengthwise direction of the floor head 12. The third opening 286 opens onto the floor facing surface of the floor head 12. Formation 280 is formed integrally as part of the floor head housing. In embodiments, formation 280 may be formed as a separate component part.

The blocking member 310 is positioned within the recess defined by formation 280 and is slidably moveable in a linear direction between its blocking and non-blocking positions therein. The blocking member 310 is made from a plastic material which is resiliently deformable. In embodiments, the blocking member 310 could be rotatably moveable.

In more detail, the blocking member 310, when seen in side cross-section, has a first part 312, a second part 314 and a third part 316. The first part 312 is accessible from below the third opening 286 and is generally V-shaped to form a user-graspable portion. The second part 314 extends upwardly and rearwardly away from the first part 312 and terminates in an engagement portion 318 for extending through the opening 282 and into engagement with formation 300. The third part 316 is positioned above the V-shaped portion of the first part 312 and extends upwardly away therefrom and passes through the second opening 284. A free end of third part 316 includes first and second leg portions which are spaced apart in a width-wise direction of the blocking member 310. Free ends of the leg portions include outwardly extending retaining members 320*a*, 320*b* that engage with the formation 280 to slidingly hold the blocking member 310 with respect to the formation 280. Formation 280 also includes inwardly extending tabs 322*a*, 322*b* for engaging with the retaining members 320*a*, 320*b* and wall 288 abuts the third part 316 to prevent movement therepast when the blocking member 310 is in its blocking position (see FIG. 13*b*) as will be explained in more detail.

The conditions of the first blocking device 296 and the second blocking device 298 are mutually exclusive such that the condition of the first blocking device 296 does not affect operation of the second blocking device 298 and vice versa.

Operation of the surface cleaning apparatus 10 to clean a surface starting from an upright storage position of the apparatus will now be described.

In the upright storage position, the first blocking device 296 is in its blocking condition and so inhibits movement of the connecting member 200 away from its upright condition. In this example, the second blocking device 298 and its blocking member 310 are in their blocking position/condition as shown in FIG. 13*a*.

In this state, the elongate member 14 and the connecting member 200 are generally aligned along a common axis and held upright because the first blocking device 296 inhibits pivotal movement of the connecting member 200 away from the upright condition. With reference to FIG. 3, the angle Θ between elongate axis C and the plane P is about 90° when the apparatus is in its upright storage condition. In embodiments, this angle may be different, e.g. it may be between 85° and 90°, or another angle, depending on where the centre of mass of the housing 16 lies, for example.

With reference to FIGS. 10*a* and 10*b*, in the upright condition of the connecting member 200, a first side 311*a* of portion 306 of the formation 304 is in abutment with the first blocking formation 290 and a first side 313*a* of the portion 308 is in abutment with the second blocking formation 309. Thus, the first blocking formation 290 through its engagement with the portion 306 inhibits rotation of the connecting member 200 in a first direction about axis A and the second blocking formation 309 through its engagement with portion 308 inhibits rotation in an opposite, second direction about axis A. The first blocking device 296 thereby inhibits any pivoting movement of the elongate member 14 and retains the surface cleaning apparatus 10 in its upright storage condition.

In order to bring the surface cleaning apparatus 10 to an in-use condition to commence cleaning, the user pulls the handle of the housing 16 so as to urge the elongate member 14 downwardly to an inclined position with respect to the floor surface. In applying this force, connecting member 200, through its connection to the elongate member 14, is also urged in the same direction and a force is exerted by portion 308 onto the second blocking formation 309. When a sufficient force is reached, the second blocking member 309 deforms and permits the portion 308 to move therepast. The connecting member 200 can now rotate about axis A downwardly towards the floor surface, at least until a second side 313*b* of the formation 304 comes into contact with the second blocking formation 309. This latter position corresponds to the elongate member 14 lying in a plane which is substantially parallel to plane P and prevents the elongate member 14 being rotated too far and potentially damaging the connecting member 200 and/or the other parts of the tool, e.g. passage 203.

With second blocking device 298 in its non-blocking condition, the connecting member 200 can pivot relatively freely about axis A with respect to the floor head 12. This may be desirable for certain cleaning applications, e.g. where the surface is uneven or deformable and so a wide range of pivotal movement about axis A in a downward direction of the elongate member is required.

The inventors have realised that in this mode of operation, which is analogous with prior art tools/cleaning apparatus, a reduction in cleaning efficiency may occur. The present invention advantageously allows the tool 11 to operate in a second mode where the range of pivotal movement is restricted and where such a range is not required. Prior art tools, however, have no other mode of operation that can limit such pivotal movement in that direction.

To explain why a reduction in cleaning efficiency occurs consider the following.

During cleaning, a user will push the housing 16 back and forth, i.e. forwards, in a direction away from the user, and rearwards, in a direction towards the user, and this causes a similar movement of the tool 11 and the elongate member 14. It has been realised by the applicant that such forward and rearward movement exert forces in different directions on the tool 11.

When the tool 11 is pushed forwards, part of the exerted force will be transmitted through the elongate member 14 in a downwards direction. This has the effect of generally urging the tool 11 closer to the floor surface.

Figure 14A:
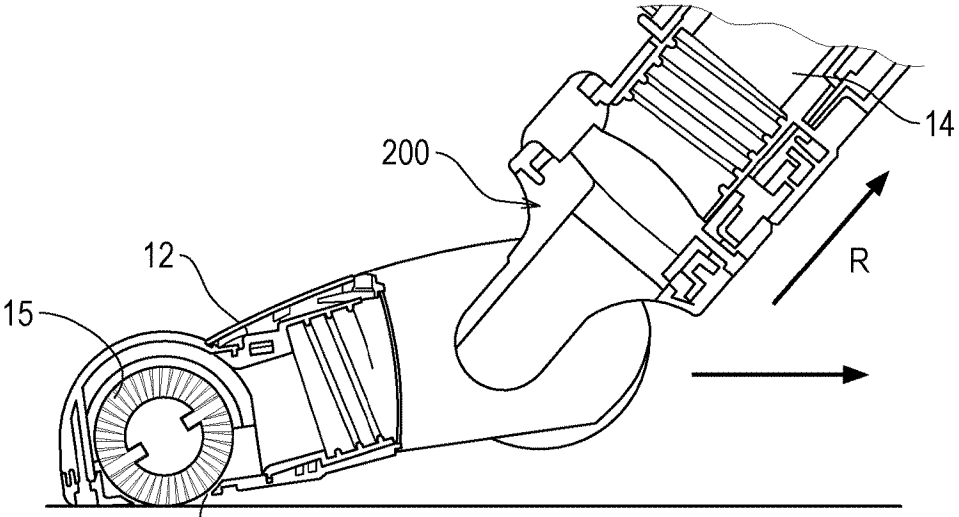
FIGS. 14*a* and 14*b* are cross-section views of the tool in a state of operation.
Figure 14B:
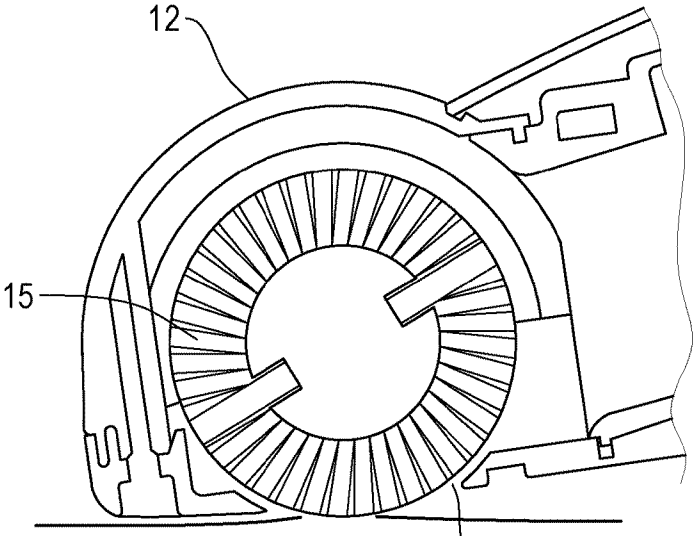
Figure 15A:
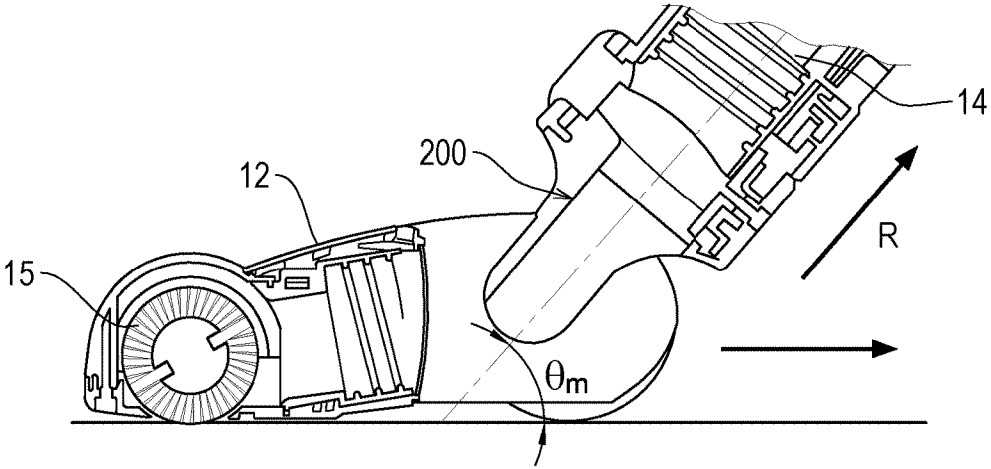
FIGS. 15*a* and 15*b* are cross-section views of the tool in another state of operation.
Figure 15B:
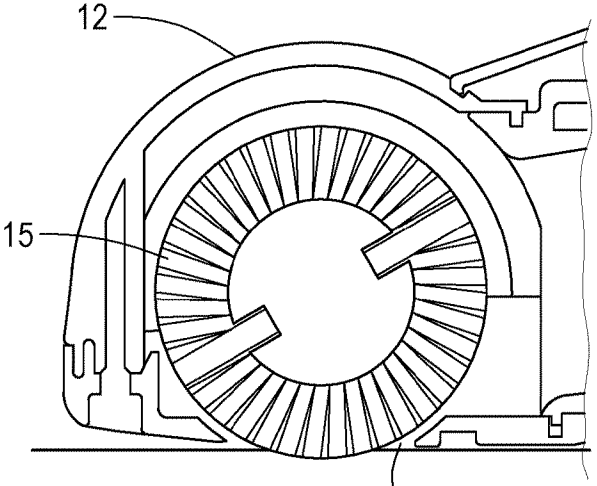

However, as shown in FIGS. 14*a* and 14*b*, when the housing 16 is pulled backwards, part of the exerted force R will be transmitted through the elongate member 14 in an upward direction. The effect of this upwardly exerted force R is that it tends to cause pivotal movement between the tool 11 and the connecting member 200. Given that, in prior art tools, the connecting member is free to pivot, the floor head 12 will tend to pivot and thereby cause the rear of the tool 11 to be lifted off the floor surface. Thus, the floor facing inlet 13 is moved away from the floor surface. Accordingly, cleaning efficiency decreases because less suction is created at the surface to extract dirt and debris therefrom. This effect can be exacerbated if the user exerts a larger force on the rearward stroke to overcome the frictional forces (which is often the case) created by the cleaning member 15 rotating in the opposite direction to the direction of the carpet pile.

The applicant has realised this drawback with the prior art and introduced the second blocking device 298 and its blocking member 310. When the second blocking device 298 is in its blocking position, pivotal movement of the connecting member 200 about axis A in this direction, i.e. on the rearward stroke, is inhibited.

In more detail, it has been surprisingly found that one need not stop all pivotal movement (although this is envisaged in embodiments) of the connecting member 200 and elongate member 14 for the purpose of avoiding such a reduction in cleaning efficiency. In fact, it has been found there are a range of values of e which are acceptable for cleaning efficiency purposes, i.e. the pre-determined in use condition, but that a marked reduction in efficiency can occur if e is less than certain minimum angles Θm. In other words, if the elongate member is inhibited from assuming an angular position below Θm, cleaning efficiencies are improved compared to the prior art. This is advantageous as it means that the tool 11 can still retain some pivotal movement making it suitable for a wider range of cleaning applications whilst it minimises any adverse effects on cleaning efficiency.

Turning to the present example, the user can selectively choose to use the second blocking device 298 for this purpose.

With reference to FIGS. 12*b* and 13*b*, the user simply slides the blocking member 310 rearwardly to bring the second blocking device 298 into its blocking condition. As the blocking member 310 is moved, its retaining members 320*a*, 320*b* come into contact with tabs 322*a*, 322*b*. The tabs 322*a*, 322*b* urge the retaining members 320*a*, 320*b* inwardly towards each other, into a retracted position, as the members move past the tabs. Once the retaining members 320*a*, 320*b*, have moved past the tabs, the members 320*a*, 320*b* spring back to their original, unretracted, positions. The tabs 322*a*, 322*b* thus prevent the blocking member 310 from inadvertently being moved between blocking and non-blocking positions during cleaning. In other words, the tabs 322*a*, 322*b* co-operate with the retaining members 320*a*, 320*b* to retain the blocking member 310 in its blocking and non-blocking positions.

When the blocking member 310 is in its blocking position, engagement portion 318 extends into the recess 302 defined by formation 300. On the rearward stroke during cleaning, the elongate member 14 may move pivotally about axis A to some degree without contact being made between the blocking member 310 and the respective walls 302*a*, 302*b* of recess 302 (see FIG. 13*b*) until a minimum angle Θm is reached at which point engagement portion 318 engages with the respective wall 302*b* (see FIG. 15*a*). When the minimum angle Θm has been reached, wall 302*b* abuts the second blocking member 300, via engagement portion 318. Further movement in this direction is thus inhibited. Thus, the elongate member 14 can no longer pivot any further in this direction.

After cleaning is finished, the user can move the elongate member 14 to its non-use upright condition by which action the first blocking member moves against the retaining member 306 to return to its blocking position.

The applicant has found that having a pre-determined use condition corresponding to an angle Θ between the elongate axis C and the first plane P being at least 35° is advantageous. Thus, the elongate member 14 can be moved between a range of angles when the second blocking device 298 is in the blocking condition. In embodiments, it is preferable for the angle Θ in the predetermined use condition to be between 35° and 85°, or 45° and 85°, or the minimum angle Θm to be at least 45°. In certain embodiments, it is more preferable that the angle Θ in the predetermined use condition to be between 55° and 85° or the minimum angle Θm to be at least 55°. In embodiments, it is preferred for the angle Θ to be between 50° and 60°, more preferably 60° and 85°, or the minimum angle Θm to be at least 60°.

In embodiments, the angle Θ may be between 65° and 85°, or the minimum angle Θm is at least 65°. In some embodiments, having the angle Θ to be between 70° and 85°, or the minimum angle Θm at least 70° is preferred. In some embodiments, the angle Θ may be between 75° and 85°, or the minimum angle Θm is at least 75°.

Embodiments of the invention have been developed and tested by the applicant to quantify the improvements in dust and debris pick-up. In the testing, all conditions were kept the same except for the second blocking device being in its blocking or non-blocking condition.

In one embodiment, it was found that the pick-up was increased by 3.3% by using the second blocking device in its blocking condition and setting the minimum angle Θm to 55°. In another embodiment, pick-up was increased by 4.3% by setting Θm to 50°.

Embodiments described have first and second blocking devices. Other embodiments may only have a (second) blocking device for inhibiting pivotal movement of the connecting member to the pre-determined in use condition with no further (first) blocking device for inhibiting movement away from an upright storage condition.

Embodiments described have a blocking member that permits pivotal movement over a range of in-use angles. In other embodiments, the blocking member may lock the connection member at a single angle, for example the minimum angle(s) Θm described above, and stop movement away therefrom in either rotational direction about axis A.

The connecting member 200 may, in embodiments, not have first and second parts pivotally connected to one another. Instead, it may be a single part having one end pivotally connected about axis A to the floor head and an opposite end connectable to the elongate member 14. Similarly, the connecting member 200 and floor head may have other shapes or connection means to provide the pivotal connection to the floor head. All that is required is that the connection means or member provides a pivotal connection to the elongate member 14.

In embodiments, different forms of blocking member for use with the second blocking device may be utilised. All that is required is that the blocking member inhibits pivotal movement of the connecting member outside of a predetermined use condition.

Although embodiments have been described with reference to a surface cleaning apparatus including a handheld cleaner and elongate member connected to a tool, a tool according to embodiments of the present invention may be used with any cleaner having an elongate member to which the tool may be attached. For example, the tool may be attached to an elongate member of a cylinder cleaner. The elongate member may be rigid and may be connected at one end to a corrugated tube which fluidly connects the elongate member to a suction source of the cylinder cleaner. In embodiments, the tool may be attached to an elongate member of an upright cleaner.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A tool for a surface cleaning apparatus comprising:

a floor head including a floor facing surface which defines an inlet for receiving dirt-laden air, which inlet is generally positioned in a first plane P;

a passage for carrying dirt-laden air from the floor head to the surface cleaning apparatus;

a connecting member for connecting the tool to the surface cleaning apparatus, wherein the floor head and connecting member are pivotally connected about an axis A; and a blocking device for inhibiting pivotal movement of the connecting member about axis A, wherein the blocking device is moveable relative to the connecting member to a blocking condition and to a non-blocking condition, wherein while the blocking device is in the blocking condition, downward pivotal movement of the connecting member below a minimum angle is inhibited but upward pivotal movement of the connecting member to a greater angle than the minimum angle is permitted, and wherein while the blocking device is in the non-blocking condition, downward pivotal movement of the connecting member below the minimum angle is permitted and upward pivotal movement of the connecting member to a greater angle than the minimum angle is permitted.

2. A tool according to claim 1 wherein the first plane P and the floor surface lie in the same plane.

3. A tool according to claim 1 wherein the connecting member includes a portion which is rotatably supported by the floor head to provide the pivotal connection between the connecting member and the floor head.

4. A tool according to claim 1 wherein the connecting member includes:

a first part which is pivotally connected to the floor head; and a second part for connection to the surface cleaning apparatus, wherein the first and second parts are pivotally connected about an axis B which is transverse to axis A.

5. A tool according to claim 1 wherein the connecting member defines a space for receiving the passage therethrough.

6. A tool according to claim 1 wherein the passage is provided by a corrugated tube.

7. A tool according to claim 1 further including a further blocking device for inhibiting pivotal movement of the connecting member away from an upright storage condition while in a blocking condition, the further blocking device permitting pivotal movement of the connecting member away from an upright storage position while in a non-blocking condition, wherein the blocking device is configured to be moveable between the blocking condition and the non-blocking condition while the further blocking device is in either the blocking condition or the non-blocking condition.

8. A tool according to claim 7 wherein the further blocking device blocks all movement of the connecting member when the further blocking device is in its blocking condition.

9. A tool according to claim 1 wherein a part of the blocking device has a user-graspable portion for the user to move the blocking device into and out of its blocking condition.

10. A tool according to claim 9, wherein the user-graspable portion is accessible from the floor facing surface of the tool.

11. A tool according to claim 1 wherein the floor facing surface includes a recess within which at least a part of the blocking device is positioned.

12. A tool according to claim 11 wherein the recess is positioned rearwardly of the floor facing inlet.

13. A tool according to claim 1, wherein the blocking device includes:

a blocking member moveable between blocking and non-blocking positions which correspond to the blocking and the non-blocking conditions of the blocking device; and a formation for engaging the blocking member when the blocking member is in its blocking position to prevent the connecting member moving below the minimum angle Θm, wherein the blocking member is provided on one of the connecting member or the floor head, and the formation is provided on the other of the connecting member or the floor head.

14. A tool according to claim 13, wherein the formation includes a recess and the blocking member includes an engagement portion that extends into the recess when the blocking member is in its blocking position.

15. A tool according to claim 13, wherein the connecting member includes a portion which is rotatably supported by the floor head to provide the pivotal connection between the connecting member and the floor head, wherein the formation is provided on the rotatably supported portion.

16. A tool according to claim 1, wherein the connecting member has an elongate axis C and the minimum angle Θm between the elongate axis C and the first plane P being greater than or equal to 35°, such that while the blocking device is in the blocking condition, pivotal movement of the connecting member is permitted between about 35° and about 90°, and wherein while the blocking device is in the non-blocking position, pivotal movement of the connecting member below 35° is permitted.

17. A tool according to claim 16, wherein the minimum angle Θm is at least 45°.

18. A tool according to claim 16 wherein while the blocking device is in the blocking condition, pivotal movement is permitted to be any angle between 35° and 85°.

19. A tool according to claim 16 wherein the passage has an axis which is co-axial with axis C.

20. A tool for a surface cleaning apparatus comprising:

a floor head including a floor facing surface which defines an inlet for receiving dirt-laden air, which inlet is generally positioned in a first plane P;

a passage for carrying dirt-laden air from the floor head to the apparatus;

a connecting member having an elongate axis C for connecting the tool to a surface cleaning apparatus, wherein the floor head and connecting member are pivotally connected about an axis A;

a first blocking device for inhibiting pivotal movement of the connecting member away from an upright storage condition; and a second blocking device for inhibiting pivotal movement of the connecting member about axis A, wherein the second blocking device is moveable relative to the connecting member to a blocking position and a non-blocking position, wherein in the blocking position the second blocking device inhibits downward rotation of the connecting member about axis A such that a minimum angle Θm between the connecting member and the floor head is at least 35° and permits upward rotation of the connecting member about axis A to an angle of at least 50° between the connecting member and the floor head.

21. A tool for a surface cleaning apparatus according to claim 20, wherein in the blocking position the second blocking device inhibits downward rotation of the connecting member such that a minimum second angle Θm between the elongate axis C and the first plane P is at least 45°, wherein upward rotation of the connecting member to an angle of approximately 90° is permitted while the second blocking device is in the blocking position, and wherein while the blocking device is in the non-blocking condition, downward pivotal movement of the connecting member below the 45° is permitted and upward pivotal movement of the connecting member to an angle of approximately 90° is permitted.

22. A tool according to claim 20 wherein the first blocking device is moveable to a blocking condition in which pivotal movement of the connecting member downwardly away from an upright storage position is inhibited, and a non-blocking condition in which pivotal movement of the connecting member downwardly away from the upright storage position is permitted, wherein the first blocking device is configured to be moveable between the blocking condition and the non-blocking condition while the second blocking device is in either the blocking condition or the non-blocking condition.

23. A tool according to claim 20 wherein, when the second blocking device is in its blocking position, movement of the connecting member is permitted to be any angle between 35° and 85° whilst the second blocking device is in its blocking position.

24. A tool according to claim 20, wherein the second blocking device includes:

a blocking member moveable between blocking and non-blocking positions which correspond to the blocking and the non-blocking conditions of the second blocking device; and a formation for engaging the second blocking member when the second blocking member is in its blocking position to prevent the connecting member moving below the minimum angle Θm, wherein the second blocking member is provided on one of the connecting member or the floor head, and the formation is provided on the other of the connecting member or the floor head.

* * * * *